United States Patent [19]

Leyrat

[11] 3,953,931

[45] May 4, 1976

[54] EXCAVATOR

[75] Inventor: Pierre J. Leyrat, Trilport, France

[73] Assignee: Societe Anonyme: Poclain, Le-Plessis-Belleville, France

[22] Filed: Feb. 24, 1975

[21] Appl. No.: 552,210

[30] Foreign Application Priority Data

Mar. 1, 1974 France ..... 74.07104

[52] U.S. Cl. ..... 37/87; 37/90; 37/191 R; 37/117.5

[51] Int. Cl.[2] ..... E02F 5/06

[58] Field of Search ..... 37/191, 192, 90, 83–89, 37/DIG. 2

[56] References Cited

UNITED STATES PATENTS

| | | | |
|---|---|---|---|
| 1,569,091 | 1/1926 | Kean | 37/87 |
| 3,785,071 | 1/1974 | Schaeff | 37/90 |
| 3,854,608 | 12/1974 | Arnold | 37/117.5 X |

*Primary Examiner*—Stephen C. Pellegrino
*Attorney, Agent, or Firm*—Lewis H. Eslinger; Alvin Sinderbrand

[57] ABSTRACT

An excavator comprising a plurality of buckets mounted on an endless chain on a jib, and a bottomless scoop at the working end of the jib through which the buckets pass in use. The scoop is power operated to break up the soil being excavated, and as each bucket passes through the scoop it co-operates with the scoop to form a complete digging bucket.

5 Claims, 2 Drawing Figures

EXCAVATOR

This invention relates to a public works machine fitted with equipment which enables the said machine to carry out continuous excavating operations.

An excavator of known type comprises buckets fixed to a continuously moving chain mounted on a jib or balance beam the said buckets follow one behind another down to the excavation site then, filled, rise the length of the jib to discharge onto a conveyor belt located at the top of the excavator, finally to follow one another down again empty to recommence the operation cycle. Such excavators can only be employed in light soil because the penetrating force of each bucket is limited to the fragility of its link with the jib along or on which it moves. The excavation of hard ground by these systems requires the presence on site of an additional machine to break up the ground beforehand. Without the presence of this additional machine for this type of ground one needs to resort to machines having a single bucket which must be emptied after each digging phase, the time taken for these emptying operations being a diminishing factor in the overall efficiency of the engine.

The invention which seeks to remedy these disadvantages, proposes a machine, an embodiment of which enables continuous digging in a non-soft soil and which thus combines the advantages of continuous bucket excavators and the advantages of conventional single bucket excavators.

Accordingly, the present invention provides a public works machine comprising a main frame, a jib hinged at one end to the main frame, a balance beam hinged at one end to the jib and fitted with an endless bucket chain conveyor able to move in translation along the said balance beam, and a bottomless scoop fitted to the free end of the balance beam and comprising a transverse blade carried on two lateral arms hinged on the balance beam the scoop being such that buckets carried by chain are able to pass one after the other through the scoop, each one working in conjunction with the scoop at the moment it passes between the above-mentioned arms to create temporarily a complete bucket.

In a preferred embodiment at least one of the said lateral arms comprises a component which is retractable at the moment that each bucket on the chain passes through, thus acting as a rear stop for each bucket on the chain when, in conjunction with the bottomless scoop, each bucket becomes temporarily a complete bucket.

Figure 1:
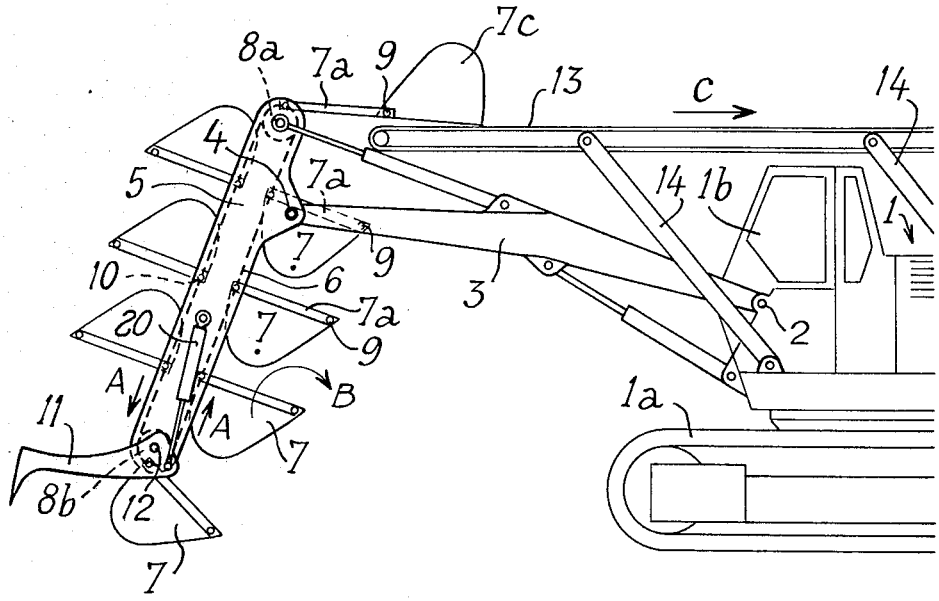
Figure 2:
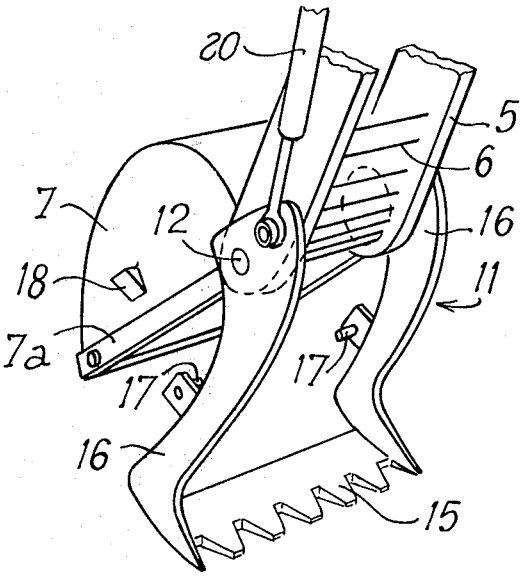

The invention will be better understood from the following description of a preferred embodiment thereof, given by way of example only, reference being had to the accompanying drawing, wherein;

FIG. 1 is a general diagrammatic view of an embodiment of machine according to the invention; and FIG. 2 is a detailed view of part of the machine of FIG. 1.

The public works machine shown in FIG. 1 comprises a main frame 1, made up of a carrying chassis 1*a* and a turret 1*b* on which a jib 3, hinged around spindle 2, carries a balance beam 5 by means of hinge 4. The balance beam is provided with a chain 6 carrying buckets 7. As used in this specification the word "chain" means any endless component able to carry buckets. The chain 6 maybe actuated in a translation, movement in the direction of arrows A by means of two wheels 8*a* and 8*b* around which the said chain runs, driven in rotation by any suitable means (not shown). The buckets 7 are attached to chain 6 through the medium of supporting arms 7*a* at the ends of which buckets 7 are fitted to pivot around spindles 9. The pivoting action may take place around spindle 9 in the direction of arrows B under the influence for example of a plunger unit (not illustrated) attached to balance beam 5 or to jib 3 adjacent to spindle 4. The bucket will then take up position 7*c* in the Figure. End 10 of each arm 7*a* comprises in known manner a locking device able to work in conjunction with components located on the balance beam thus ensuring its locking action when the above-mentioned plunger unit operates. A unit integral with the balance beam or any other component on the machine is provided which is able to return the bucket from its position 7*c* to that in which it is locked on arms 7*a*. The said unit, also the plunger unit, may be combined in one single component, for example, a jack coupled between bucket 7 and arm 7*a* as described in French Patent No. 7,342,029 dated Nov. 26, 1973.

Balance beam 5 has a bottomless scoop 11 fixed to its free end. The bottomless scoop 11 is hinged on the balance beam at 12. A conveyor belt 13, attached to turret 1*b* on the machine by means of arms 14, may be adjusted in regard to height by movement of the said arms. Hydraulic jacks mounted between the hinged units are provided for movements of the said units hinged one above the other.

FIG. 2 illustrates, in prespective a detail of FIG. 1 in the region of bottomless scoop 11. Bottomless scoop 11 comprises a blade with a transverse leading edge 15 supported by two lateral arms 16 hinged at 12 on balance beam 5. The opening formed by these three components is such that a bucket 7 is able to pass through the scoop 11 when there is a translation movement of chain 6. Each bucket 7 cooperates with the two arms 16 and blade 15, at the moment when its mouth coincides with the opening of the scoop to creat temporarily a complete bucket, that is to say a bucket provided with a leading edge blade, a bottom and two rigid lateral sides. A component 17, fixed to one of arms 16, and which is able to retract during the passage of each bucket 7 or chain 6, constitutes a rear stop for each of the said buckets when the said bucket is in its above-mentioned position of coincidence. The said component 17 may be a spring activated stop, working in conjunction with a boss provided to match, on one of the sides of bucket 7.

It is preferable that each arm 16 be fitted with a component 17 and that each side of the buckets be fitted with a boss 18 in order that the load be distributed evenly in the region of bucket 7.

In operation, chain 6 moves along balance beam 5, taking buckets 7 along with it. Bottomless scoop 11 is manoeuvred by regulating the inlet of pressurised fluid into the jacks 20 which control its movement in such a manner that blade 15 penetrates the ground to be excavated and removes chunks of the said ground. Buckets 7, passing in turn through the bottomless scoop 11, collect these chunks. Stops 17, which prevent buckets 7 from refusing to accept the soil due to the resistant force present in these chunks, ensure good filling. Full buckets climb up balance beam 5 near the top of which they are emptied onto conveyor belt 13 after having been unlocked from arms 7*a*, by the action of the plunger units mentioned earlier, the said conveyor belt being actuated in a translation movement in the direction of arrow C. This conveyor belt ensures the transfer of the soil to the rear of the machine where, for example, it falls into a tipping truck. Buckets 7 are then returned to their initial position in relation to arms 7*a*, are then locked in this position and travel down balance beam 5 until they reach the bottomless scoop where they are reloaded.

It is advantageous to adjust the height of conveyor belt 13 to suit the angle of jib 3 so that the conveyor belt is always correctly positioned in relation to buckets 7.

It is evident that the above described enables a continuous excavating process to be carried out in hard compacted soil by means of the bottomless scoop 11 and the spoil thus excavated to be removed in a continuous manner. Thus there is no lost time or time used exclusively for emptying the buckets, the emptying process being a work phase which takes place simultaneously to the soil penetration and chunk breaking-away phase. The overall output to the machine is accordingly considerably increased.

What is claimed is:

1. A public works machine comprising, a main frame, a jib hinged at one end to the main frame, a balance beam hinged at one end to the jib; an endless bucket chain conveyor movably mounted on said balance beam for movement in translation along said balance beam and including a plurality of buckets thereon, and a bottomless scoop mounted on the free end of the balance beam and including a transverse blade and two lateral arms hinged on the balance beam, said scoop having an opening therein located to permit buckets carried by said chain conveyor to pass one after the other through the scoop, and cooperating means on said scoop and said bucket for preventing rearward movement of the bucket with respect to the scoop as it passes between the lateral arms of the scoop through said opening, thereby to create temporarily a complete bucket.

2. A machine according to claim 1, wherein said cooperating means includes retractable means on at lest one of said lateral arms for retracting out of said opening when each bucket on the chain conveyor passes through the opening and for forming a rear stop for each bucket at a predetermined position of the bucket with respect to the scoop, thereby creating temporarily a complete bucket in conjunction with the bottomless scoop.

3. A machine according to claim 1 wherein said scoop includes jack means for selectively pivoting the scoop on the balance beam.

4. A machine according to claim 3 wherein said jack means are mounted between the lateral arms of the scoop and the balance beam.

5. A machine according to claim 1 wherein said buckets are pivotally mounted on arms secured to the conveyor, and said machine includes pivoting means for pivoting full buckets into an emptying position.

* * * * *